US006938519B2

(12) United States Patent
Boyd et al.

(10) Patent No.: US 6,938,519 B2
(45) Date of Patent: Sep. 6, 2005

(54) AUTOMATIC BREAKOUT WRENCH WITH FLOATING GRIPPING DIES

(75) Inventors: James W. Boyd, New Berlin, WI (US); Jack W. Nelson, Milwaukee, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 57 days.

(21) Appl. No.: 10/610,724

(22) Filed: Jul. 1, 2003

(65) Prior Publication Data

US 2005/0000324 A1 Jan. 6, 2005

(51) Int. Cl.[7] ..... B25B 13/50
(52) U.S. Cl. ..... 81/57.33; 81/186
(58) Field of Search ..... 81/57.11–57.36, 81/186

(56) References Cited

U.S. PATENT DOCUMENTS 2,517,366 A * 8/1950 Wilson ..... 81/186
2,596,880 A * 5/1952 Weiss ..... 81/186
2,609,720 A * 9/1952 Barnard ..... 81/186
2,720,128 A * 10/1955 Woolley ..... 81/186
2,962,919 A * 12/1960 Grundmann et al. ..... 81/186
3,205,736 A * 9/1965 Crickmer ..... 81/186
3,215,010 A * 11/1965 Montgomery et al. ..... 81/186
4,128,135 A 12/1978 Mitchhart et al. ..... 175/52
4,648,292 A * 3/1987 Haynes et al. ..... 81/57.16
5,542,318 A * 8/1996 Wesch, Jr. ..... 81/57.33
5,653,297 A 8/1997 Whisenhunt ..... 175/52
6,070,500 A * 6/2000 Dlask et al. ..... 81/57.33

* cited by examiner

*Primary Examiner*—David B. Thomas
(74) *Attorney, Agent, or Firm*—James Earl Lowe, Jr.

(57) ABSTRACT

A die assembly adapted to be attached to one of a wrench first arm and a wrench second arm. The die assembly includes a die having a pipe facing front spaced apart from but parallel to the pipe longitudinal axis, a wrench facing rear, and two spaced apart opposed sides, each connected to the die front and die rear. The die is thick on one side and thin on the other side so that the die facing front has a face that recedes from the pipe from one edge to the other edge so that contact between the die facing front varies depending upon the diameter of the pipe. The die rear also has a convex curve so that the die has a thick mid section.

13 Claims, 5 Drawing Sheets

AUTOMATIC BREAKOUT WRENCH WITH FLOATING GRIPPING DIES

BACKGROUND OF THE INVENTION

This invention relates to deck wrenches used on blasthole drills, and, more particularly, to deck wrench dies for gripping the drill pipe.

Blasthole drills are large machines used to drill holes for explosives in mining operations. A conventional blasthole drill comprises a frame supported by crawlers for movement over the ground, and a mast supported by the frame for movement between a substantially vertical position and a number of angled or non-vertical positions. The mast defines a drill hole axis. A rotary head moves relative to the mast along the drill hole axis. The rotary head engages the upper end of a drill pipe for rotating the drill pipe and driving the drill pipe into the ground. When drilling a blasthole that is deeper than the height of the mast, more than one section of drill pipe must be used. After the first section of drill pipe is driven into the ground, the rotary head moves back to the top of the mast and another section of drill pipe is connected to the top of the first section. The rotary pipe then drives the second section into the ground. It is not unusual to use four sections of drill pipe. Such a deep blasthole is referred to as a "multi-pass" blasthole.

After drilling a multi-pass blasthole, it can be difficult to break the joint between two pipe sections. A blasthole drill typically includes an automatic breakout wrench for breaking a joint if the rotary head cannot do so. An automatic breakout wrench is disclosed in U.S. Pat. No. 4,128,135. The automatic breakout wrench turns the upper pipe section while the lower pipe section is held by deck wrenches.

A conventional breakout wrench includes a swing arm pivotable relative to the mast between extended and retracted positions. A wrench member pivots relative to the swing arm about the drill hole axis when the swing arm is in the extended position. The wrench member carries dies for gripping the pipe section. A clamping jaw pivots relative to the wrench, member between a clamping position and a non-clamping position. The jaw also carries a die for gripping the pipe section. When the swing arm is in the extended position, movement of the jaw to the clamping position causes the pipe section to be gripped by the dies on the jaw and on the wrench member. Thereafter, pivotal movement of the wrench member relative to the swing arm (the clamping jaw moves with the wrench member) turns the pipe section to break the joint. Pivotal movement of the wrench member is caused by a hydraulic breakout cylinder connected between the swing arm and the wrench member.

In U.S. Pat. No. 5,653,297, shims allow for adjustment of the dies to compensate for pipe wear and to accommodate different pipe sizes. More particularly, the pipe section is gripped by two dies mounted on the wrench member and by one die mounted on the clamping jaw. Each die is held in place by upper and lower fasteners. Shims can be inserted behind each die to adjust the position of the die. Each shim has therein an aperture through which the upper fastener extends to hold the shim in place. The bottom of each shim has therein an upwardly extending slot through which the lower fastener extends. The shim is removed by loosening the lower fastener and by removing the upper fastener from the shim aperture. The slot in the shim allows upward movement of the shim relative to the lower fastener, while the lower fastener maintains the position of the shim.

Two problems occur with current break out wrenches. One is that when a drill pipe wears from the abrasion of bailing rock from the hole, a reduction in pipe diameter occurs, and the amount of reduction varies and is greater near the bottom of the pipe, because the bottom of the pipe is in the hole longer, than near the top of the pipe. This results in a tapering of the pipe known as penciling. The current wrench dies do not accommodate tapered pipe, so the die does not make proper contact with the pipe and hence has difficulty gripping the worn pipe. The second problem is that current wrenches require shims to be added to the wrench as the pipe diameter reduces from wear. Typically, this is not done by the mine due to a lack of knowledge or desire to manually bolt in the shims. As a result, the wrench slips on the pipe.

SUMMARY OF THE INVENTION

One of the objects of the invention is to allow the die to match the taper of a worn pipe.

Another of the objects of the invention is to allow the die to make line contact with pipes of different diameters without using shims.

The invention provides a die assembly for a drilling machine adapted to use drill pipe with a longitudinal axis, the drilling machine including a pipe turning wrench including a first arm and a second arm pivotable about an axis spaced apart from and parallel to the pipe longitudinal axis, and a die pocket, in the one of the wrench first arm and wrench second arm, that is adapted to receive the die assembly. The die assembly is adapted to be attached to one of the wrench first arm and the wrench second arm, and the die assembly includes a die having a pipe facing front spaced apart from but parallel to the pipe longitudinal axis, a wrench facing rear, and two spaced apart opposed sides, each connected to the die front and die rear. The die is thick on one side and thin on the other side so that the die facing front has a face that recedes from the pipe from one edge to the other edge so that contact between the die facing front varies depending upon the diameter of the pipe. The die rear also has a convex curve so that the die has a thick mid section. The die assembly further includes means for attaching the die to the die pocket. The means for attaching the die to the pocket includes the die having a hole extending through the die from one side to the other opposed side, and a pin that extends through the die hole. A die assembly further includes a bracket, and the bracket is attached to the one of the wrench first arm and wrench second arm in the die pocket. The bracket has two aligned openings on the inside of each of two opposed bracket walls, and the pin extends through the die hole, and each end of the pin being received in a respective one of the bracket side wall openings.

Other features and advantages of the invention will become apparent to those skilled in the art upon review of the following detailed description, claims and drawings in which like numerals are used to designate like features.

Figure 1:
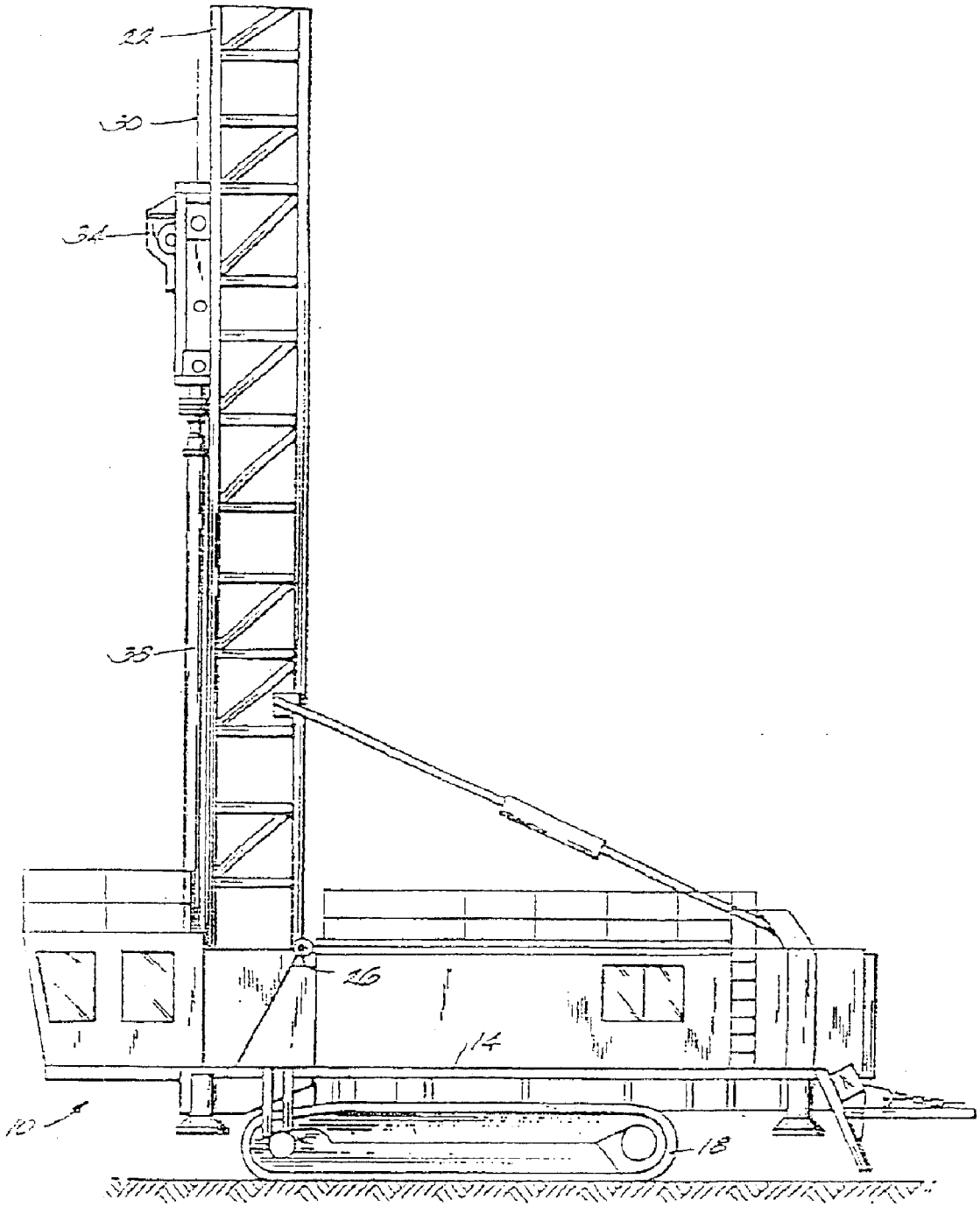
FIG. 1 is a side view of a blasthole drill embodying the invention and including a deck wrench.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof. The use of "consisting of" and variations thereof herein is meant to encompass only the items listed thereafter and the equivalents thereof.

DETAILED DESCRIPTION OF THE PREFERRED EMBODIMENT

Illustrated in FIG. 1 is a blasthole drill 10 embodying the invention. The blasthole drill 10 comprises a frame 14 supported by crawlers 18 for movement over the ground. A mast 22 is supported by the frame 14 for movement relative thereto about a generally horizontal axis 26 between a substantially vertical position (as shown) and a number of angled or non-vertical positions (not shown). The mast 22 defines a drill hole axis 30. A rotary head 34 is movable relative to the mast 22 along the drill hole axis 30. The rotary head 34 is selectively engageable with an upper end of a drill pipe 38 supported relative to the mast 22. The drill pipe 38 includes a longitudinal axis which coincides with the drill hole axis 30. The drill pipe 38 can comprise a single drill pipe section or multiple drill pipe sections. The blasthole drill 10 thus far described is conventional and will not be described in greater detail.

Figure 2:
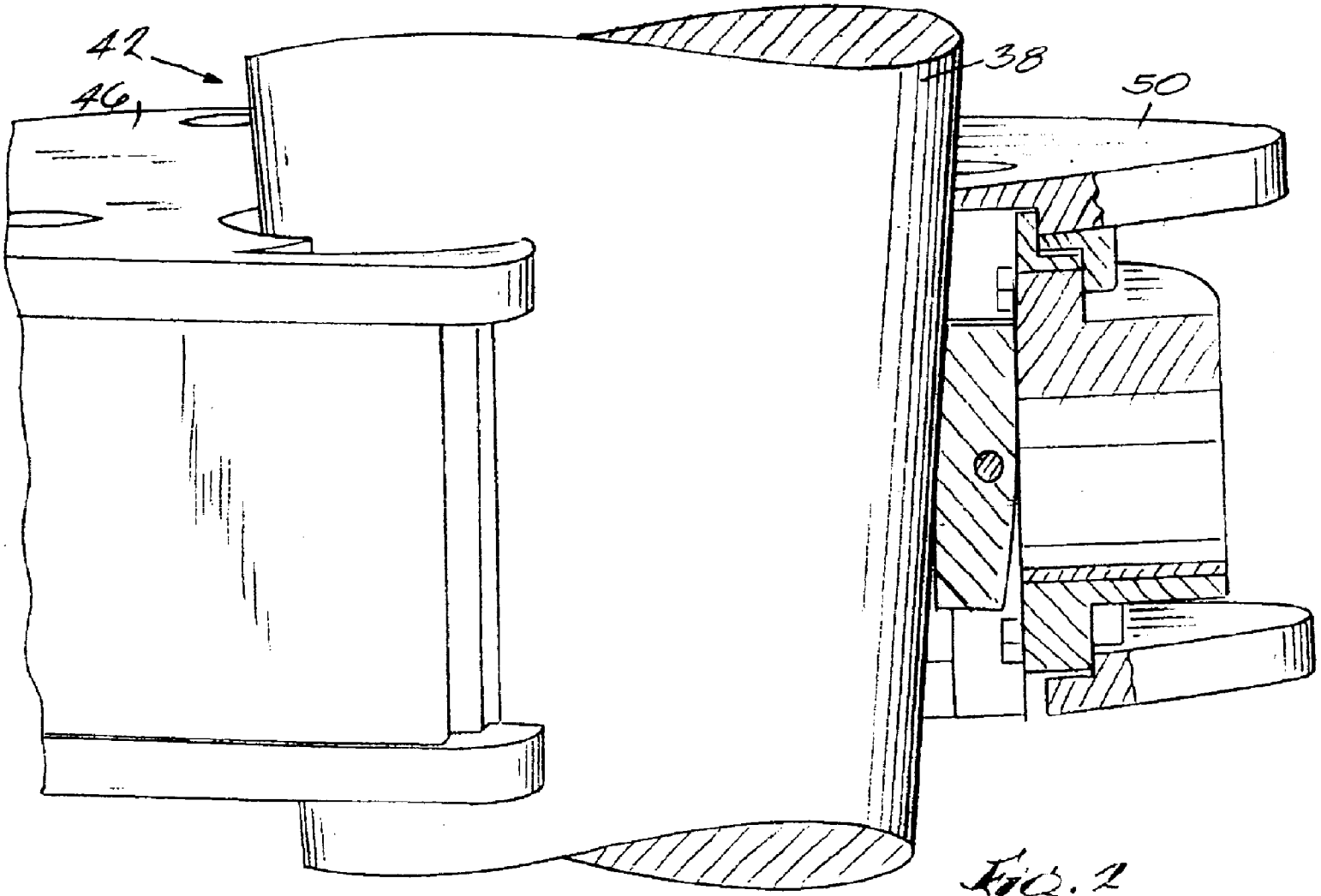
FIG. 2 is a perspective view of a deck wrench engaging a drill pipe, the deck wrench including the floating dies of this invention.

Referring now to FIG. 2, the blasthole drill 10 comprises a deck wrench 42 mounted on a drill deck (not shown). The frame 14 (FIG. 1) supports the drill deck as is known. The drill deck includes an opening (not shown) through which the drill pipe 38 extends.

Figure 3:
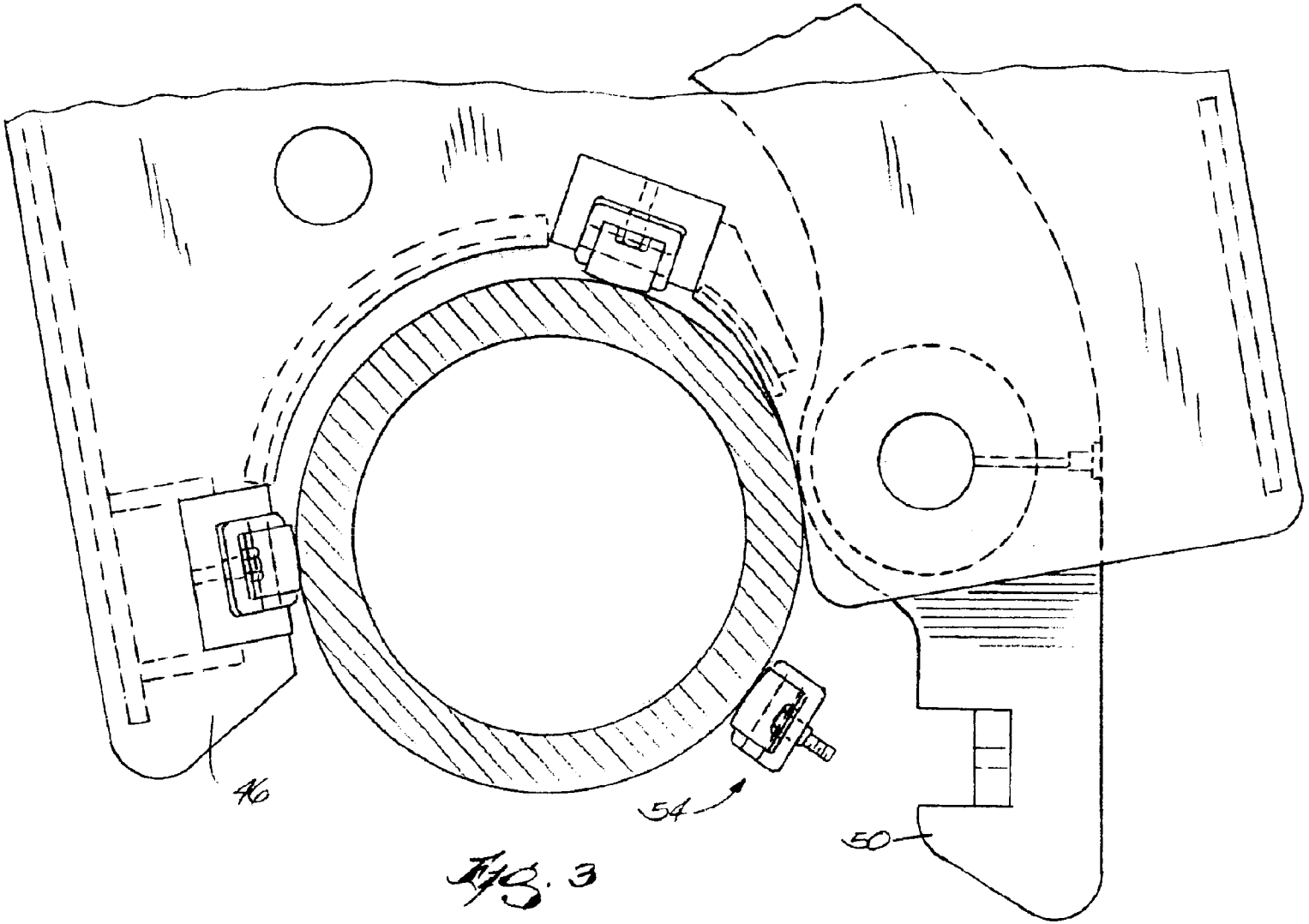
FIG. 3 is a top plan view of the deck wrench and drill pipe.
Figure 4:
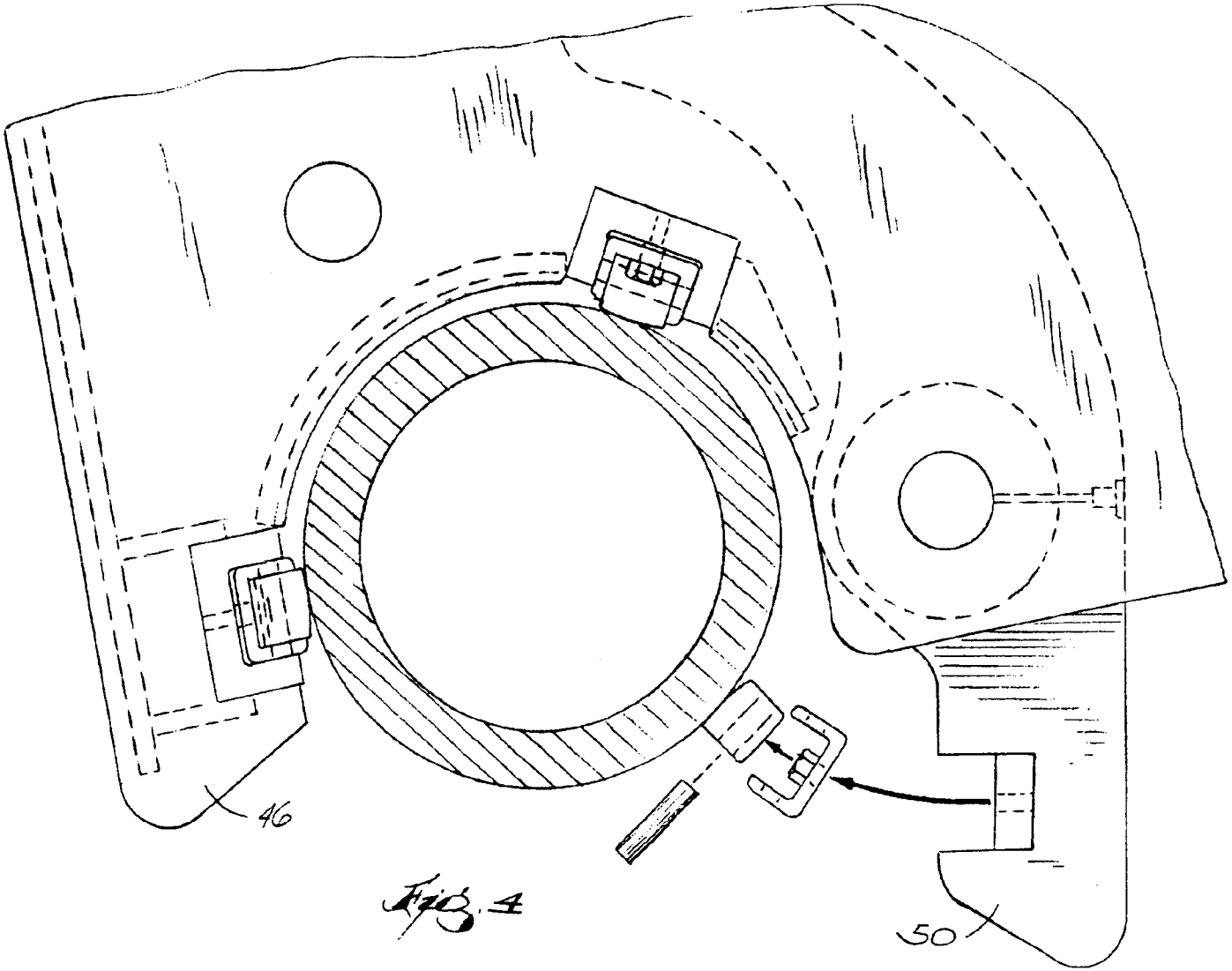
FIG. 4 is a top plan view of the deck wrench and drill pipe similar to FIG. 3, showing how the floating dies engage the drill pipe after it is worn.

As best seen in FIGS. 2, 3 and 4, the pipe turning wrench 42 includes a first arm or wrench member 46 and a second arm or clamping jaw 50 pivotable about an axis spaced apart from and parallel to the pipe longitudinal axis, and a die assembly 54 attached to one of the wrench first arm 46 and the wrench second arm 50. More particularly, there are 3 die assemblies 54, two on the wrench first arm or wrench member 46 and one on the wrench second arm or clamping jaw 50. In FIGS. 3 and 4, the die assembly 54 attached to the clamping jaw 50 is removed from the clamping jaw 50 and is shown in its position when the clamping jaw is pivoted toward the drill pipe 38.

Figure 5:
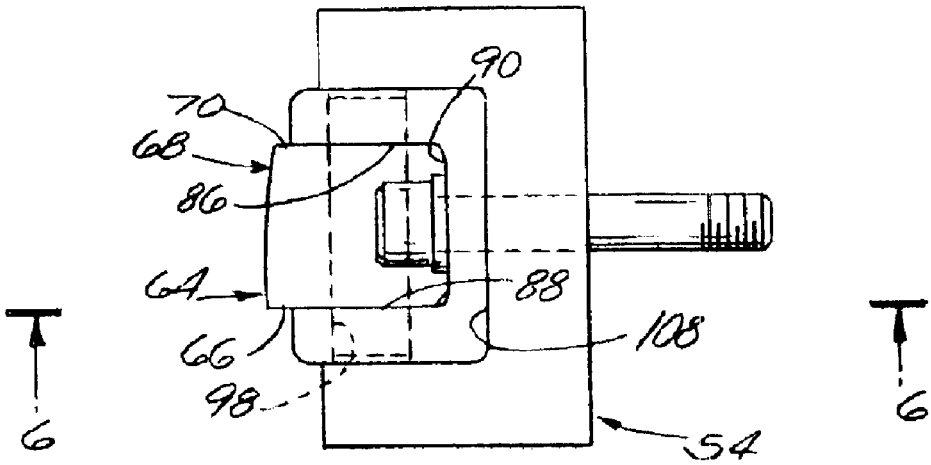
FIG. 5 is an enlarged top view of one of the floating dies in a bracket attached to an arm.
Figure 6:
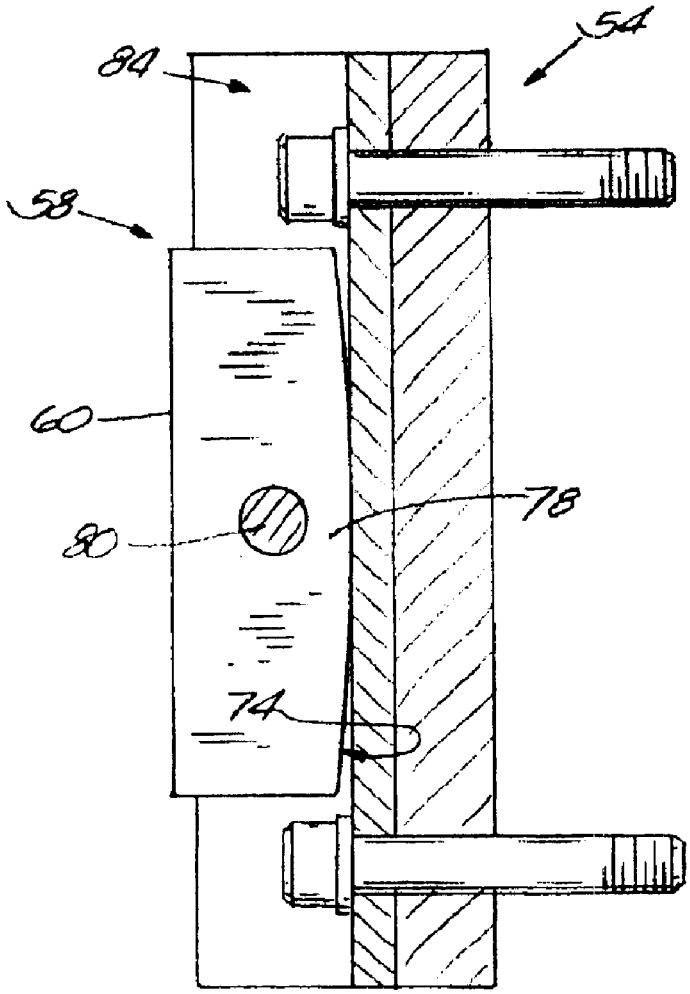
FIG. 6 is a cross-sectional view taken along line 6—6 of FIG. 5.

As best seen in FIGS. 5 and 6, the die assembly 54 includes a die 58, the die 58 having a pipe facing front 60. The die front 60 is spaced apart from but parallel to the pipe longitudinal axis, and the die pipe facing front 60 has a face that recedes from a thick first edge 64 formed by one side 66 to a thin second edge 68 formed by the other side 70. In the preferred embodiment, the die face is roughened to assist in gripping the drill pipe 38. The curved pipe facing front 60 permits contact between the die face and the pipe 38 depending upon the diameter of the pipe 38. FIG. 3 shows how, before the pipe 38 is worn, the thin side of the die face contacts the pipe 38. FIG. 4 shows how, when the pipe is worn, the thick side of the die face contacts the pipe 38.

As shown in FIGS. 2 and 6, the die 58 further includes a wrench facing rear 74, the die rear 74 having a convex curve so that, the die 58 has a thick mid section 78. The die also has a hole extending through the die 58 from one side 66 to the other opposed side 70.

As shown in FIGS. 5 and 6, the breakout wrench 42 further includes a die pocket 84, in the one of the wrench first arm 46 and wrench second arm 50, that receives the die 58, the pocket 84 being generally u-shaped with two opposed side walls, 86 and 88 and a back wall 90 connected to the side walls. In this embodiment, there are three die pockets; one for each of the three die assemblies 54.

In this embodiment, the pocket 84 is in a separate bracket 94 bolted by bolts 102 into die pockets 108 on the breakout wrench 42. In other embodiments (not shown), the bracket 94 can be omitted and the die assembly can be received directly into the die pocket 108. The bracket 94 further has two aligned openings 96 and 98 on the inside of each of the opposed bracket walls, and means for attaching the die to the bracket 94. The die attaching means comprises a pin 100 that extends through the die hole 80, each end of the pin 100 being received in a respectively one of the bracket side wall openings 96 and 98.

The floating die assemblies 54 thus address the problems listed above. The back of the die 58 is curved which allows the die 58 to rock back and forth. This movement allows the die 58 to match the taper of a worn pipe (see FIG. 4). The clamping forces of the wrench 42 are also taken as bearing stress to the die rear curved surface. These forces are not taken by the small pin 100 which is needed to keep the die 58 from falling out of the die bracket 94 when the wrench 42 is not clamped to a pipe. And because the gripping surface of the die is curved, this allows the die to make line contact with pipes of different diameters without the need for shimming (see FIGS. 3 and 4).

Various other features of the invention are set forth in the following claims.

What is claimed is:

1. A pipe turning wrench adapted to turn drill pipe, said wrench including a die assembly, a first arm, a second arm pivotable about an axis spaced apart from and parallel to said pipe longitudinal axis, and a die pocket, in one of the wrench first arm and wrench second arm, that is adapted to receive said die assembly, said die assembly being attached to one of said wrench first arm and said wrench second arm, said die assembly including a die having a generally planar pipe facing front having side edges, and a wrench facing rear, and wherein said die is thick on one side and thin on the other side so that said die facing front recedes from one said front side edge to the other said front side edge so that contact between said die facing front and a pipe varies depending upon the diameter of the pipe, and wherein said die assembly further includes means for attaching said die to said die pocket.

2. A wrench in accordance with claim 1 wherein said means for attaching said die to said pocket includes said die having a hole extending through the die from one side to an other opposed side, and a pin that extends through said die hole.

3. A wrench in accordance with claim 2 and further including a bracket, and said bracket is attached to said one of said wrench first arm and wrench second arm in said die pocket.

4. A wrench in accordance with claim 3 wherein said bracket has two aligned openings on the inside of each of two opposed bracket walls, and said pin extends through the die hole, and each end of the pin is received in a respective one of the bracket side wall openings.

5. A wrench in accordance with claim 1 wherein said die has a top and a bottom and wherein said die rear has a convex curve so that said die has a thick mid section, a thin top and a thin bottom.

6. A pipe turning wrench adapted to turn drill pipe, said wrench including a die assembly, a first arm, a second arm pivotable about an axis spaced apart from and parallel to said pipe longitudinal axis, and a die pocket, in one of the wrench first arm and wrench second arm, that is adapted to receive said die assembly, said die assembly being attached to one of said wrench first arm and said wrench second arm, and said die assembly including a die having a pipe facing front, a top, a bottom, a wrench facing rear having a convex curve so that said die has a thick mid section, a thin top and a thin bottom, and means for attaching said die to said die pocket.

7. A wrench in accordance with claim 6 wherein said means for attaching said die to said pocket includes said die having a hole extending through the die from one side to an other opposed side, and a pin that extends through said die hole.

8. A wrench in accordance with claim 7 and further including a bracket, and said bracket is attached to said one of said wrench first arm and wrench second arm in said die pocket.

9. A wrench in accordance with claim 8 wherein said bracket has two aligned openings on the inside of each of two opposed bracket walls, and said pin extends through the die hole, and each end of the pin being received in a respective one of the bracket side wall openings.

10. A die adapted to be used with a pipe turning wrench, said die having a wrench facing rear, and a generally planar pipe facing front having two side edges, said die being thick on one side and thin on the other side so that said front recedes from one front edge to the other front edge.

11. A die in accordance with claim 10 wherein said die has a top and a bottom and wherein said side edges extend between said top and bottom.

12. A die in accordance with claim 11 wherein said die has a top and a bottom and wherein die rear has a convex curve so that said die has a thick thicker mid section, a thinner top and a thinner bottom.

13. A die adapted to be used with a pipe turning wrench, said die having a pipe facing front, a top, a bottom and a wrench facing rear having a convex curve so that said die has a thick mid section, a thin top and a thin bottom.

* * * * *